United States Patent [19]

Smith

[11] 4,133,336

[45] Jan. 9, 1979

[54] VENTILATED STOVE

[76] Inventor: Alva T. Smith, Rte. 6, Box 21, Hendersonville, N.C. 28739

[21] Appl. No.: 837,895

[22] Filed: Sep. 29, 1977

[51] Int. Cl.[2] ..... F24C 15/32

[52] U.S. Cl. ..... 126/21 A; 126/273 A; 219/400

[58] Field of Search ..... 126/21, 21 A, 273 R, 126/273 A, 299, 300; 219/400

[56] References Cited

U.S. PATENT DOCUMENTS

| | | | |
|---|---|---|---|
| 3,612,032 | 10/1971 | Kweller et al. | 126/21 A |
| 3,882,843 | 5/1975 | Barnett | 126/273 A |
| 4,071,739 | 1/1978 | Jenn | 219/400 |

*Primary Examiner*—Edward G. Favors
*Attorney, Agent, or Firm*—Bailey, Dority & Flint

[57] ABSTRACT

A ventilated stove for use in recreational vehicles and the like that includes an oven which is divided into an upper and lower compartment. Positioned between the upper and the lower compartments is a gas burner. A reversible blower communicates with the oven through a duct and can be selectively rotated for causing the air to flow upwards over the burner into the upper oven or downwards through the burner to the lower compartment of the oven. An access door is provided in the rear of the oven so that food can be inserted in the oven from outside of the vehicle. A valve means is provided in the duct for withdrawing combustible by-products from surface burners carried on top of the stove.

6 Claims, 5 Drawing Figures

VENTILATED STOVE

BACKGROUND OF THE INVENTION

The present invention relates to a stove and more particularly to a ventilated stove for use in recreational vehicles and the like.

Ventilated gas-operated stoves are well known and one such stove is disclosed in U.S. Pat. No. 3,587,555. In this particular stove, an exhaust fan is used for drawing air from around the gas burners carried on top of the stove as well as for withdrawing air from an oven compartment. Similarly operated gas stoves are disclosed in U.S. Pat. Nos. 2,102,616 and 2,512,118. Another conventional gas stove utilizes a gas burner in the bottom of an oven and a blower for withdrawing the air from around the gas burner up over the top portion of the oven and redirecting the air back into the oven over, in and around the foods being cooked. This oven is also provided with a vent for venting a portion of the air from the oven.

SUMMARY OF THE INVENTION

The invention pertains to a stove and more particularly to a stove which can be utilized inside of small areas such as recreational vehicles and the like. The stove includes an oven which has a rear access door that extends through a side wall of the recreational vehicle so that food can be inserted into a lower compartment thereof from outside of the vehicle. Controls are provided on the outside of the vehicle so that the gas and heat can be regulated. A gas-operated burner is carried in the oven between a lower compartment and an upper compartment. A reversible blower communicates with the oven through a duct. The reversible blower can be selectively rotated in opposite directions to either draw air into the oven through the lower compartment up, over, and through the gas burner into the upper compartment. When using the oven as a broiler, the blower is reversed drawing the air through the duct work, down through the upper compartment, over and through the gas burner, into the lower compartment for broiling or cooking the food carried therein. The duct means through which the air flows has a valve interposed therein which automatically opens and closes according to the direction of flow of air. When the valve is opened, air is drawn around burners carried on top of the stove for exhausting by-products of combustion. This minimizes fumes from entering into the recreational vehicle during cooking. The oven is vented through a side wall of the recreational vehicle, outside of the vehicle.

Accordingly, it is an object of the present invention to provide an oven which can be utilized in relatively small spaces inside of recreational vehicles, boats, homes, etc.

Another important object of the present invention is to provide a gas operated stove which has a blower that can be reversed to control the direction that the air is circulated through the oven.

Another important object of the present invention is to provide a gas-operated stove which has surface burners positioned on the top thereof which are vented back down through the oven and exhausted outside of the recreational vehicle.

Still, another important object of the present invention is to provide a gas-operated stove which has both a front and a rear door enabling food to be inserted into an oven forming part thereof from either inside the recreational vehicle or from outside the recreational vehicle.

These and other objects and advantages of the invention will become apparent upon reference to the following specifications, attendant claims, and drawings.

DESCRIPTION OF THE PREFERRED EMBODIMENT

Figure 1:
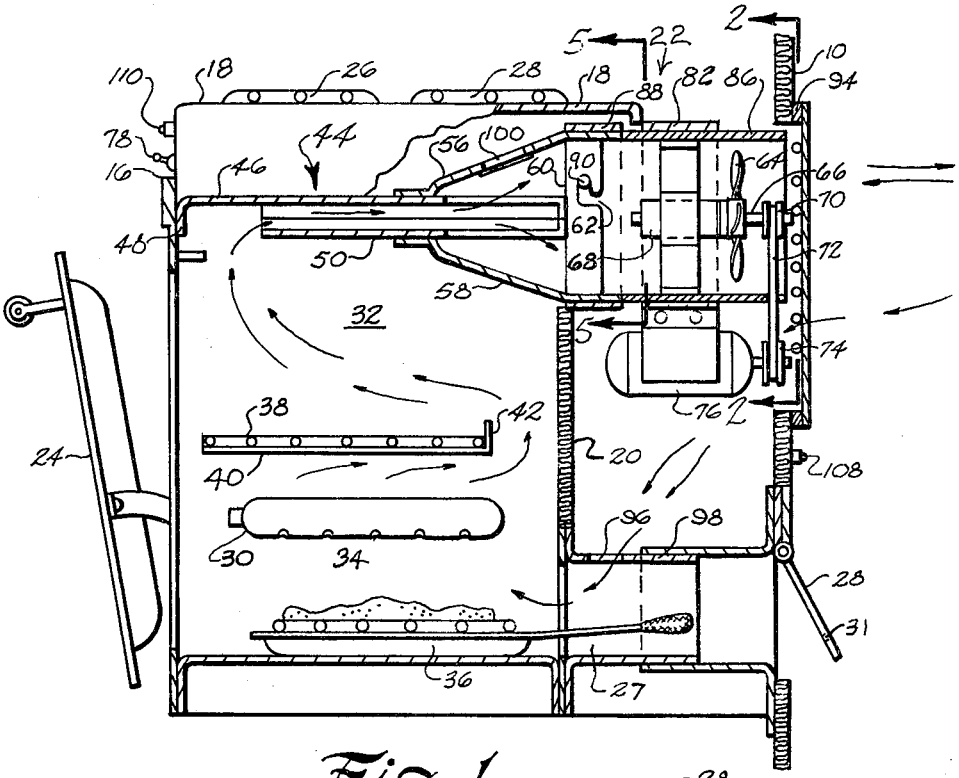
FIG. 1 is a side elevational view partially in section, illustrating a gas-operated stove constructed in accordance with the present invention.

Referring in more detail to FIG. 1 of the drawing, there is illustrated a stove mounted in a side wall 10 of a recreational vehicle. It is to be understood, of course, that the stove could be utilized in many different places such as in boats, condominiums, and/or homes. The stove has side walls 12 and 14 which are joined by a front 16 and a top 18. The stove also has a rear wall 20 through which a blower 22 extends. A hinged door 24 is carried on the front of the stove for providing access to the oven.

Gas-operated burners 26 and 28 are carried on top of the stove. The gas connections, the electrical connections, as well as the electrical controls for the stove, are not illustrated since such are connected up in a conventional manner.

The rear wall 20 of the oven is spaced from the side wall 10 of the recreational vehicle and adjacent the bottom thereof is a substantially rectangular shaped passage 27 that extends from the oven through the side wall 10 of the recreational vehicle. A hinged door 28 is provided adjacent the outer end of the passage 26 for providing access to a lower portion of the oven. Vent holes 31 are carried in the hinged door 28.

A gas burner 30 is located in the lower portion of the oven defining a first upper cooking compartment 32 thereabove and a lower cooking compartment 34 therebelow. Normally, the lower cooking compartment 34 is utilized for broiling food. As can be seen in FIG. 1, access to the lower cooking compartment 34 is provided through either the front hinged door 24 or the rear hinged door 28. A pan 36 upon which the food that is to be cooked is inserted into the lower compartment 34 of the oven through the rear access door 28 by a person located outside of the recreational vehicle. This enables one to cook in the oven while sitting outside.

A food shelf 38 is carried between the side walls of the oven directly above the burner 30 and has a baffle plate 40 extending across the bottom thereof which terminates in a vertically extending flange 42. The vertically extending flange 42 limits the distance that pans or food can be inserted into the oven.

Figure 5:
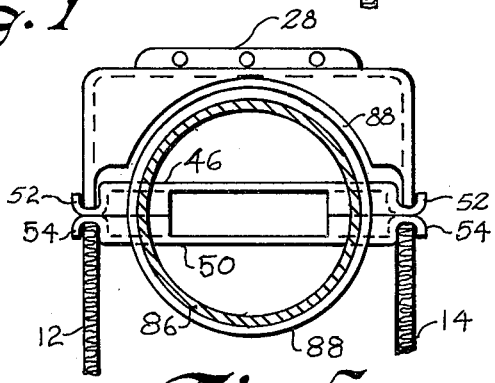
FIG. 5 is a sectional view taken along line 5—5 of FIG. 1.
Figure 4:
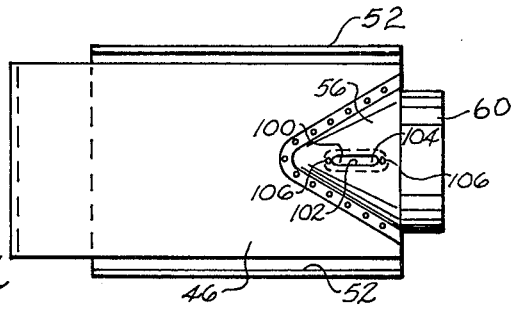
FIG. 4 is an enlarged top plan view of the duct illustrated in FIG. 3.
Figure 3:
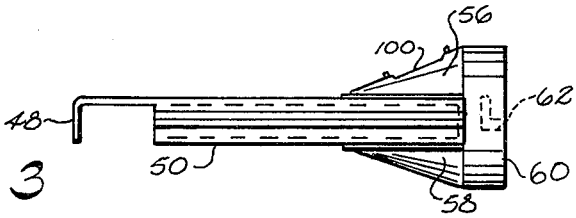
FIG. 3 is an enlarged side elevational view illustrating an air flow duct means utilizes in the stove of FIG. 1.

A duct means 44 is carried adjacent the upper portion of the oven and is defined by a horizontally extending top plate 46 which is secured to the front wall 16 of the oven by means of a vertically extending flange 48 that is welded thereto. The horizontal top plate 46 extends rearwardly to adjacent the rear wall 20 of the oven. Spaced vertically below the horizontally extending top plate 46 is a bottom plate 50. The outer edges 52 and 54 of the top and bottom plates 46 and 50, respectively, are joined together and extend through elongated slots provided in the side walls 12 and 14 for supporting the duct means 44. Such is best illustrated in FIG. 5. An air funnel defined by spaced diverging flange members 56 and 58 extends from the top plate 46 and bottom plate 50 as illustrated in FIGS. 1, 3 and 4. Adjacent the outer ends of the diverging plate 56 and 58 is a circular band 60 that has an L-shaped slot 62 provided therein. The top and bottom plates 46 and 50 have a substantially V-shaped portion cut out so that when air flows between the upper and lower plates 46 and 50, it is allowed to flow into the air funnel as illustrated in FIG. 1.

A blower is provided for circulating air through the oven. The blower includes a fan blade 64 that is secured to a shaft 66 which is, in turn, rotatably carried within a bearing 68. A pulley 70 is carried on the end of the shaft 66 and has a belt 72 extending therearound. The belt 72 extends around another driven pulley 74 carried on the end of an output shaft of an electric motor 76. The electric motor 76 is a reversible motor that is controlled by a toggle switch 78 provided on the front of the oven.

The motor 76 is hung within a bracket 80 which extends downwardly from a cylindrical band 82. A nut and bolt 84 is used for securing the motor 76 within the bracket 80. The cylindrical band 82 is drawn tight on a tubular housing 86 which extends from substantially the rear wall 10 of the trailer inwardly to adjacent the cylindrical member 60 carried adjacent the outer end of the air funnel. The tubular member 86 has a slightly larger diameter band 88 welded to the inner end thereof which has a post 90 provided thereon so that the blower can be readily attached to the circular end 60 of the air funnel by means of the post 90 sliding within the slot 62 providing bayonet lock.

Figure 2:
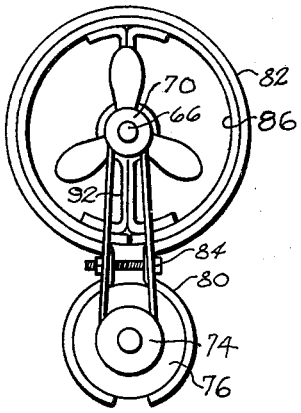
FIG. 2 is a rear elevational view, taken along line 2—2 of FIG. 1.

The bearing 68 in which the shaft 66 is journaled is, in turn, supported on bracket 92 carried within the tubular housing 86 such as best illustrated in FIG. 2.

A grille 94 is secured to the outer wall 10 of the recreational vehicle by any suitable means such as screws so that air can be withdrawn by the blower through the duct means 44. When the blower 64 is rotating in one direction, air is exhausted out from the grille 94. When the blower 64 is rotated in the opposite direction, air is drawn in through the grille in the other direction. It is then drawn through the duct means 44 into the oven. The air is also allowed to circulate down below the motor 76 and through an opening 96 provided in a plate 98 for entrance and exit from the lower cooking compartment 34.

In order to vent the surface burners 26 and 28, a valve means 100 is provided in the upper surface 56 of the air funnel. This valve means includes an elongated slot 102 which has a flexible membrane constructed of any suitable material such as rubber positioned on an inner side thereof. The flexible membrane 104 is secured to the plate 56 by means of brads 106 carried on opposite ends thereof. When air is flowing through the duct means 44 in the direction shown in FIG. 1, the flexible member 104 breaks the seal around the elongated slot 102 allowing air to be drawn through the surface burners 26 and 28 and exhausted out of the recreational vehicle. However, when the blower is reversed so that air is drawn from the outside of the recreational vehicle through the duct means 44 to the front of the oven, the pressure forcing against the flexible member 104 closes the valve means. Gas-regulating knobs 108 and 110 are carried on both the front of the oven and in the side wall 10 of the recreational vehicle for controlling the flow of gas to the burner 30. This enables the cooking operation to be controlled from either inside the vehicle or from the outside.

The stove, of course, is equipped with other valves for controlling the gas flow to the surface burners 26 and 28.

In operation, if it is desired to broil food in the lower compartment of the oven, the food can either be placed therein through the front door 24 or through the rear door 28 carried in the outer wall of the recreational vehicle. The switch 78 is set so that the blower draws air in from the outside of the recreational vehicle through the duct means 44 from right to left, down through the upper cooking compartment 32, in and around the gas burner 34 for applying the heated air to the food 36. The air then flows back up through the opening 96 provided in the upper plate of the exit port and also through the vent holes provided in the rear door 28. Therefore, no fumes are allowed to escape inside of the recreational vehicle.

When it is desired to cook within the upper portion 32 of the oven, the blower is reversed so that air is drawn through the grille 94 and the vent holes 30 provided in the rear door through the lower cooking compartment 34 and up and over the burner 30. It then passes around the baffle plate 40 to the rear of the oven, up through the upper compartment 32 for cooking the food therein, through the duct 44, the air funnel, past the blower, and is exhausted out of the grille work 94. When air is flowing in this direction, if the surface burners 26 and 28 are being used, the vent means 100 is also opened for venting the by-products of combustion from the surface burners 26 and 28, down through the air vent and out the rear of the recreational vehicle.

The blower is capable of operating at a high and low speed as well as in a forward and reverse direction.

As a result of circulating the air through the oven, exhaust by-products from combustion are vented outside of the recreational vehicle and the moving air speeds up the cooking operation. The lower surface 50 of the duct means also aids in cooking in the upper compartment by radiation.

While a preferred embodiment of the invention has been described using specific terms, such description is for illustrative purposes only, and it is to be understood that changes and variations may be made without departing from the spirit or scope of the following claims.

What is claimed is:

1. A stove for use in a recreation vehicle and the like comprising:

an oven having side walls, a front access door and a rear wall;

a rear access door providing access to said oven from outside of said vehicle;

a gas operated burner carried in said oven;

a first cooking compartment disposed above said gas burner;

a second cooking compartment disposed below said gas burner;

a reversible blower communicating with said oven;

means for selectively rotating said blower in a first direction for causing air to flow through said second cooking compartment up past said gas burner into said first cooking compartment; and means for selectively rotating said blower in a second direction causing air to flow through said first cooking compartment down past said gas burner into said lower second cooking compartment;

whereby food can be inserted into said lower cooking compartment from outside said vehicle and said blower can be rotated in a direction to force air over said burner for being heated and onto and around said food for cooking said food.

2. The stove as set forth in claim 1 further comprising:

vent means operably associated with said blower for venting the air flowing through said oven outside said vehicle.

3. The stove as set forth in claim 1 further comprising:

surface burners carried on top of said stove;

a duct means carried adjacent the top of said oven below said surface burners;

said blower means communicating with said duct means providing a passageway for said air as it is circulated through said oven; and valve means interposed in said duct means below said surface burners for drawing air from around said surface burners when said blower is rotated in said first direction;

whereby exhaust of byproducts from combustion caused by said surface burners is vented outside of said vehicle through said vent means.

4. The stove as set forth in claim 4 further comprising:

a movable closure forming part of said valve means for automatically closing said valve means when said blower means is rotated in said second direction.

5. The stove as set forth in claim 1 further comrising:

said reversible blower including:

(i) a fan blade; and (ii) a motor for rotating said fan blade;

a removable housing; and said reversible blower being carried in a removable housing.

6. A gas operated stove comprising:

an oven having side walls, a front access door and a rear wall;

surface burners carried on top of said oven;

a gas operated burner carried in said oven;

duct means adjacent the top of said oven below said surface burners;

a reversible blower;

said blower means communicating with said duct means providing a passageway for air moved thereby as said air is circulated through said oven;

a first cooking compartment disposed above said burner;

a second cooking compartment disposed below said burner;

means for selectively rotating said blower in a first direction for causing air to flow through said second cooking compartment up past said gas burner into said upper compartment and through said duct means;

means for selectively rotating said blower in a second direction causing air to flow through said duct means, said first cooking compartment down past said gas burner into said lower second cooking compartment; and valve means interposed in said duct means below said surface burners for drawing air from around said surface burners when said blower is rotated in said first direction.

* * * * *